United States Patent [19]

Whitney et al.

[11] 4,379,120

[45] Apr. 5, 1983

[54] SULFIDATION RESISTANT NICKEL-IRON BASE ALLOY

[75] Inventors: C. Raymond Whitney; Andrew R. Walsh, both of Reading, Pa.

[73] Assignee: Carpenter Technology Corporation, Reading, Pa.

[21] Appl. No.: 172,681

[22] Filed: Jul. 28, 1980

[51] Int. Cl.[3] ..... C22C 19/05

[52] U.S. Cl. ..... 420/448; 148/162

[58] Field of Search ..... 75/171, 170; 148/32, 148/32.5, 162

[56] References Cited

U.S. PATENT DOCUMENTS 3,972,713 8/1976 Muzyka et al. ..... 75/171

OTHER PUBLICATIONS

Woodyatt, Sims & Beattie, Jr.; "Prediction of Sigma-Type Phase Occurrence from Compositions in Austenitic Superalloys", Transactions of the Metallurgical Society of AIME, vol. 236; Apr. 1966; pp. 519-527.

Sims, "A Contemporary View of Nickel-Base Superalloys", Journal of Metals, Oct. 1966, pp. 1119-1130.

*Primary Examiner*—R. Dean

*Attorney, Agent, or Firm*—Edgar N. Jay

[57] ABSTRACT

A sulfidation-resistant alloy containing about 0.02-0.08 w/o carbon, 21-24.5 w/o chromium, 52-60 w/o nickel, 1-3.5 w/o molybdenum, 1.75-3.25 w/o titanium, 0.75-2.25 w/o aluminum, 0.50-2 w/o columbium, up to 0.02 w/o boron and the balance iron, the elements being balanced to provide an average electron-vacancy number Nv not greater than 2.54. When so balanced, the alloy is stabilized against the formation of no more than 10 v/o Cr-rich alpha phase. Preferably, the elements are balanced so that Nv is not greater than 2.45 and better yet not greater than 2.40.

4 Claims, No Drawings

SULFIDATION RESISTANT NICKEL-IRON BASE ALLOY

This invention relates to a sulfidation resistant nickel-iron base alloy and, more particularly, to such an alloy containing nickel, iron, chromium, molybdenum, titanium, aluminum and columbium critically balanced with controlled amounts of carbon.

In U.S. Pat. No. 3,972,713 granted to D. R. Muzyka and C. R. Whitney on Aug. 3, 1976 and assigned to the assignee of the present application, there is set forth a sulfidation-resistant alloy containing the following elements in the amounts indicated in percent by weight, the balance being iron.

TABLE I

| | Broad | Intermediate | Preferred |
|---|---|---|---|
| C | 0.02–0.08 | 0.04–0.065 | 0.04–0.065 |
| Mn | 2 Max. | 0.25 Max. | 0.20 Max. |
| Si | 0.25 Max. | 0.20 Max. | 0.20 Max. |
| P | 0.03 Max. | 0.02 Max. | 0.015 Max. |
| S | 0.03 Max. | 0.02 Max. | 0.015 Max. |
| Cr | 21–26 | 22.0–24.5 | 22.0–23.5 |
| Ni | 52–58 | 53–56 | 54–56 |
| Mo | 1–3.5 | 1.5–2.5 | 1.5–2.5 |
| Ti | 1.75–3.25 | 2.25–2.75 | 2.25–2.75 |
| Al | 0.75–2.25 | 1.25–1.75 | 1.25–1.75 |
| Cb | 0.50–2 | 0.75–1.50 | 0.75–1.50 |
| B | up to 0.02 | 0.002–0.008 | 0.002–0.008 |

To avoid unnecessary repetition, the disclosure of said 3,972,713 patent is included here in its entirety by reference.

The alloy of the 3,972,713 patent has demonstrated outstanding sulfidation resistance when subjected to temperatures ranging from about 1200 to 1500 F. (648–815 C.) combined with good hot strength under the conditions present in diesel type internal combustion engines. As brought out in said patent, the alloy is balanced with sufficient chromium to ensure the required sulfidation resistance without over balancing the alloy so as to lead to the formation of excessive amounts of an undesired phase identified as body-centered cubic chromium-rich alpha phase. In practice, it has proven to be both time consuming and expensive to determine a desirable balance for a specific composition even within the relatively narrow ranges of the intermediate and preferred ranges set forth above. This may be better appreciated when it is understood that certain test specimens, after having been heat treated and aged, were found to be essentially free of alpha phase and remained so after exposure to a temperature of 1500 F. for 10 hours or even 100 hours, but then developed chromium-rich alpha phase when exposed for an extended time of 1000 to 1500 hours. Therefore, to predict long range behavior under adverse conditions, such long time-temperature tests are required extending for 1000 or 1500 hours or even longer. While it is possible to carry out such tests, they are nevertheless time consuming and expensive, as was noted.

Hitherto, it has been recognized that predicting the occurrence of sigma phase and related intermetallic compounds could be facilitated by relying upon the average electron-per-atom density or the average electron-vacancy number (Nv) as it is usually referred to. In this connection, attention is directed to Woddyatt, Sims and Beattie: Transactions of the Metallurgical Society of AIME, 1966, Vol. 236, No. 4, pp. 519–527, which introduces a computerized process, PHACOMP, for use in predicting the occurrence of sigma and related intermetallic phases.

The present invention stems from the discovery that there is a maximum critical value Nv which can be used with a high degree of reliability to predict the formation of the unwanted chromium-rich, body-centered cubic, alpha phase even though such a phase is not related to the intermetallic phases such as sigma, etc. which were the subject of the work done by Woodyatt et al and others. Tests that have been carried out indicate that when the composition of the alloy of the 3,972,713 patent is modified, as indicated (in weight percent, w/o) for the purpose of summary in Table II and by restricting the content of the alloy to provide Nv values, when calculated using PHACOMP, of not more than about 2.54, an alpha phase content of no more than 10 v/o can be assured after exposure for 1500 hours at temperatures of 1200–1500 F. Preferably, the value of Nv is limited to no more than about 2.45 to ensure extremely low levels of Cr-rich alpha phase. Better yet, a content which limits the value of Nv to no more than 2.40 will provide a composition containing no more than a trace if not entirely free of chromium-rich alpha phase after prolonged exposure to high temperature.

TABLE II

| | Broad | Preferred |
|---|---|---|
| C | 0.02–0.08% | 0.03–0.06% |
| Mn | 2 Max. | 0.20 Max. |
| Si | 0.25 Max. | 0.20 Max. |
| P | 0.03 Max. | 0.015 Max. |
| S | 0.03 Max. | 0.015 Max. |
| Cr | 21–24.5 | 22.5–22.9 |
| Ni | 52–60 | 55–58 |
| Mo | 1–3.5 | 1.7–2.3 |
| Ti | 1.75–3.25 | 2.1–2.4 |
| Al | 0.75–2.25 | 1.1–1.4 |
| Cb | 0.50–2 | 0.7–1.0 |
| B | up to 0.02 | 0.003–0.007 |

The balance of the composition is iron, except for incidental impurities which, preferably, are kept low. It is to be noted that the foregoing tabulation is provided for reference purposes and is not intended to be restrictive in that the preferred amount of one or more elements can be used with the broad amounts of the remaining elements if desired. In addition, intermediate ranges for one or more elements are contemplated and can be provided by taking its broad minimum or maximum amount with its preferred maximum or minimum, respectively.

As is expressly brought out in the 3,972,713 patent, the composition there disclosed is austenitic, the composition being balanced within the stated ranges to minimize the presence of undesirable phases. Of primary concern here is the particular need to ensure against the presence of a chromium-rich alpha phase not only in the metal in its heat-treated condition but also after prolonged exposure to temperatures of about 1200–1500 F. Thus, in accordance with the present invention, there is provided a composition which is austenitic and which is essentially, if not entirely, free of chromium-rich alpha phase after exposure to a temperature of about 1200–1500 F. for 1500 hours. By "essentially" free of chromium-rich alpha phase is meant no more than 10 v/o chromium-rich alpha phase using the Systematic Manual Point Count Method set forth in ASTM Spec. E-562. Experiments and tests have now demonstrated a definite relationship between the average electron-vacancy number (Nv) and the tendency in this composition for the formation of a chromium-rich body centered cubic (bcc) alpha phase.

In accordance with this invention, it is preferred to follow Woodyatt, Sims and Beattie, Jr. (236 Trans. of the Met. Soc., AIME 519) when calculating Nv, equivalent results are obtained but with different values for Nv when the calculations are modified by the assumptions of others. For example, when the value for a given composition is calculated following Sims, Journal of Metals, October 1966, pp. 1119–1130, the value of Nv obtained will be about 0.08 to 0.10 less than the corresponding value as stated herein. In addition to variations with regard to the extent to which specific elements themselves are affected or how they affect the matrix of the composition, further variations of about a few hundredths up to about one tenth may occur in the calculation of the average Nv number at different installations because of variations in the precision and accuracy of the techniques used to determine chemical analyses.

As brought out in the 3,972,713 patent, the alloy is prepared using conventional practices, but preferably is melted and cast into ingots by a multiple melting technique. Forging is carried out from a furnace temperature above about 1900 F. (1040 C.), preferably from about 2100–2150 F. (1150–1175 C.) followed by solution treatment of about 1875 –2100 F. (1025–1150 C.), for about 1 to 4 hours or longer if necessary, preferably at about 2000 F. (1095 C.) for 4 hours. After quenching in oil, or faster if desired, the alloy is aged by heating at about 1200–1600 F. (648–870 C.) for about 16 to 48 hours, e.g. at about 1300 F. (705 C.) for 24 hours. Double aging treatments are also suitable and usually involve aging for about 2 to 8 hours near the upper end of the temperature ranges, followed by a final age at a temperature near the lower end of the range, e.g. heating at 1600 F. for 4 hours followed by cooling in air and then heating for 4 hours at 1350 F. (732 C.) and again cooling in air.

This alloy in its heat treated condition is austenitic. The heat treatment brings out a gamma prime phase having a face centered cubic structure which helps give the alloy its high temperature strength. While up to 10 v/o chromium-rich alpha phase may be present, it is an undesired phase, and, as the amount present increases above 10 v/o, it has an increasing deleterious effect on room temperature ductility and high temperature strength. In addition, hot corrosion resistance is also adversely affected.

The following five heats were first vacuum induction melted, cast as electrodes, then electro-slag remelted and cast into ingots having the analyses indicated in Table III, in each the balance was iron and inconsequential impurities. The ingots were formed into bar stock about 0.7 inch (17.8 mm) in diameter.

TABLE III

| | Heat-1 | Heat-2 | Heat-3 | Heat-4 | Heat-5 |
|---|---|---|---|---|---|
| C | .053 | .042 | .042 | .039 | .034 |
| Mn | .12 | .18 | .14 | .10 | .06 |
| Si | .08 | .05 | .11 | .09 | .05 |
| P | .004 | .003 | .004 | .005 | .004 |
| S | .004 | .003 | .002 | .006 | .003 |
| Cr | 22.90 | 22.60 | 22.57 | 22.69 | 22.56 |
| Ni | 54.95 | 55.10 | 55.38 | 57.18 | 57.22 |
| Mo | 1.98 | 2.01 | 2.00 | 2.00 | 2.00 |
| Al | 1.65 | 1.36 | 1.24 | 1.29 | 1.26 |
| Ti | 2.57 | 2.41 | 2.26 | 2.26 | 2.27 |
| Cb | 1.12 | .99 | .96 | .88 | .90 |
| B | .0048 | .0048 | .0045 | .0047 | .0045 |

TABLE III-continued

| | Heat-1 | Heat-2 | Heat-3 | Heat-4 | Heat-5 |
|---|---|---|---|---|---|
| Nv | 2.63 | 2.54 | 2.50 | 2.45 | 2.43 |

It is apparent that the composition of each of the Heats 1–5 falls within the range of the 3,972,713 patent but only Heats 2–5 are balanced in accordance with the present invention so as to have average electron-vacancy number Nv not greater than 2.54. To facilitate comparison, the average electron-vacancy numbers Nv as calculated for each heat is also given in Table III.

Specimens from each of the Heats 1–5 were prepared so as to permit the determination of the volume percent of chromium-rich alpha phase to be determined from 10 different fields for each heat after the specimens had been exposed. In each test the exposure was for 1500 hours at two different temperatures, 1350 F. (732 C.) and 1500 F. (816 C.). The volume percent of chromium-rich alpha phase as the average of 10 fields is given in Table IV for each heat, as well as the Nv number.

TABLE IV

| | | Cr-Rich Alpha Phase | |
|---|---|---|---|
| Heat No. | (Nv) | 1350 F. (732 C.) 1500 Hrs. | 1500 F. (816 C.) 1500 Hrs. |
| 1 | (2.63) | 19.6 | 14.6 |
| 2 | (2.54) | 6.3 | 1.8 |
| 3 | (2.50) | 1.8 | 2.2 |
| 4 | (2.45) | 3.6 | 0.6 |
| 5 | (2.43) | 2.5 | 0.9 |

As is apparent from Table IV, the time-temperature relationship for precipitation of chromium-rich alpha phase is such that the rate of formation at 1350 F. is greater than at 1500 F. It should also be noted that precision of the determinations of chromium-rich alpha phase of about ±1 at about the 2 v/o level are such that 1.81 v/o for Heat-3, 3.62 v/o for Heat-4 and 2.53 v/o for Heat-5 do not significantly differ. The same applies to 1.81 v/o and 2.24 v/o for Heats-2 and -3 respectively when exposed at 1500 F. The volume percent values for Heat-1 are definitely above 10 v/o. The amount of Cr-rich alpha phase found in the heats having Nv numbers of 2.54 or less is considered negligible for most applications requiring long range thermal stability and sulfidation resistance. For the most exacting requirements, compositions balanced to provide Nv not greater than 2.45 or better yet not greater than 2.40 will ensure extremely low levels of chromium-rich alpha phase if not complete freedom therefrom. Adjustment of the composition balance to lower the average electron-vacancy number Nv can be effected by increasing nickel, carbon and/or boron, and reducing iron and/or others of the remaining elements having the larger electron-vacancy numbers.

In addition to improved stability when exposed to temperatures in the range of 1200–1500 F. for extended periods, e.g. 1500 hours, the present improved alloy is charaacterized by good hot strength and stress rupture life at elevated temperatures up to about 1500 F. The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. An austenitic nickel-iron base alloy resistant to sulfidation at elevated temperatures of about 1200–1500 F., which has good hot strength and stress rupture life at elevated temperatures up to about 1500 F. when heat treated, as well as thermal stability as indicated by freedom from the formation of more than 10 v/o chromium-rich alpha phase when exposed to temperatures of from about 1200–1500 F. for about 1500 hours, said alloy consisting essentially by weight of about

| | w/o |
|---|---|
| C | 0.02–0.08 |
| Mn | 2 Max. |
| Si | 0.25 Max. |
| P | 0.03 Max. |
| S | 0.03 Max. |
| Cr | 21–24.5 |
| Ni | 52–60 |
| Mo | 1–3.5 |
| Ti | 1.75–3.25 |
| Al | 0.75–2.25 |
| Cb | 0.50–2 |
| B | up to 0.02 |

the balance being essentially iron, and said alloy being balanced so as to have an average electron-vacancy number Nv not greater than 2.50.

2. The alloy as set forth in claim 1 containing about

| | w/o |
|---|---|
| C | 0.03–0.06 |
| Mn | 0.20 Max. |
| Si | 0.20 Max. |
| P | 0.015 Max. |
| S | 0.015 Max. |
| Cr | 22.5–22.9 |
| Ni | 55–58 |
| Mo | 1.7–2.3 |
| Ti | 2.1–2.4 |
| Al | 1.1–1.4 |
| Cb | 0.7–1.0 |
| B | 0.003–0.007 |

3. The alloy as set forth in claim 1 or claim 2 balanced so that Nv is not greater than 2.45.

4. The alloy as set forth in claim 1 or claim 2 balanced so that Nv is not greater than 2.40 and containing no more than a trace of chromium-rich alpha phase.

* * * * *

US004379120B1

REEXAMINATION CERTIFICATE (3840th)

United States Patent [19]

[11] B1 4,379,120

Whitney et al.

[45] Certificate Issued Aug. 24, 1999

[54] SULFIDATION RESISTANT NICKEL-IRON BASE ALLOY

[75] Inventors: C. Raymond Whitney; Andrew R. Walsh, both of Reading, Pa.

[73] Assignee: CRS Holdings, Inc., Wilmington, Del.

Reexamination Requests:
No. 90/004,757, Sep. 23, 1997
No. 90/005,130, Nov. 3, 1998

Reexamination Certificate for:

| | |
|---|---|
| Patent No.: | **4,379,120** |
| Issued: | **Mar. 5, 1983** |
| Appl. No.: | **06/172,681** |
| Filed: | **Jul. 28, 1980** |

[51] Int. Cl.[6] ..... C22C 19/05
[52] U.S. Cl. ..... 420/448; 148/162
[58] Field of Search ..... 420/448; 148/410, 148/419, 675

[56] References Cited

U.S. PATENT DOCUMENTS 3,972,713 8/1976 Muzyka et al. ..... 75/171

OTHER PUBLICATIONS

Woodyatt, Sims & Beattie, Jr., "Prediction of Sigma–Type Phase Occurrence from Compositions in Austenitic Superalloys," Transactions of the Metallurgical Society of AIME, vol. 236, Apr. 1966, pp. 519–527.

PYROMET 31, Alloy Digest, Dec. 1977, Ni–252.

Conference MICON 78, Apr. 3–5, 1978 and D.R. Muzyka, "Physical Metallurgy and Effects of Process Variable of the Microstructure of Wrought Superalloys," Micon 78, American Society for Testing and Materials, Mar. 1979, pp. 526–546.

*Primary Examiner*—Deborah Yee

[57] ABSTRACT

A sulfidation-resistant alloy containing about 0.02–0.08 w/o carbon, 21–24.5 w/o chromium, 52–60 w/o nickel, 1–3.5 w/o molybdenum, 1.75–3.25 w/o titanium, 0.75–2.25 w/o aluminum, 0.50–2 w/o columbium, up to 0.02 w/o boron and the balance iron, the elements being balanced to provide an average electron-vacancy number Nv not greater than 2.54. When so balanced, the alloy is stabilized against the formation of no more than 10 v/o Cr-rich alpha phase. Preferably, the elements are balanced so that Nv is not greater than 2.45 and better yet not greater than 2.40.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 3 is cancelled.

Claim 1 is determined to be patentable as amended.

Claims 2 and 4, dependent on an amended claim, are determined to be patentable.

1. An austenitic nickel-iron base alloy resistant to sulfidation at elevated temperatures of about 1200–1500 F., which has good hot strength and stress rupture life at elevated temperatures up to about 1500 F. when heat treated, as well as thermal stability as indicated by freedom from the formation of more than 10 v/o chromium-rich alpha phase when exposed to temperatures of from about 1200–1500 F. for about 1500 hours, said alloy consisting essentially by weight of about

| | w/o |
|---|---|
| C | 0.02–0.08 |
| Mn | 2 Max. |
| Si | 0.25 Max. |
| P | 0.03 Max. |
| S | 0.03 Max. |
| Cr | 21–24.5 |
| Ni | 52–60 |
| Mo | 1–3.5 |
| Ti | 1.75–3.25 |
| Al | 0.75–2.25 |
| Cb | 0.50–2 |
| B | up to 0.02 |

the balance being essentially iron, and said alloy being balanced so as to have an average electron-vacancy number Nv not greater than [2.50] *2.45*.

* * * * *